US007856844B2

(12) United States Patent
Kim et al.

(10) Patent No.: US 7,856,844 B2
(45) Date of Patent: Dec. 28, 2010

(54) COOLING AIR SUPPLY APPARATUS OF REFRIGERATOR

(75) Inventors: Sang Bae Kim, Changwon-si (KR); Tae Ho Park, Changwon-si (KR); Jeong Youl Lee, Changwon-si (KR); Deok Eun Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 539 days.

(21) Appl. No.: 11/418,503

(22) Filed: May 5, 2006

(65) Prior Publication Data

US 2006/0248916 A1 Nov. 9, 2006

(30) Foreign Application Priority Data

| | | |
|---|---|---|
| May 7, 2005 | (KR) | 10-2005-0038233 |
| May 7, 2005 | (KR) | 10-2005-0038234 |
| May 18, 2005 | (KR) | 10-2005-0041796 |
| Jun. 10, 2005 | (KR) | 10-2005-0049864 |
| Jun. 10, 2005 | (KR) | 10-2005-0049865 |

(51) Int. Cl.
*F25D 17/04* (2006.01)

(52) U.S. Cl. ..... 62/408; 62/407; 62/415; 62/441

(58) Field of Classification Search ..... 62/408, 62/415, 441, 407
See application file for complete search history.

(56) References Cited

U.S. PATENT DOCUMENTS 4,850,206 A * 7/1989 Larsen ..... 62/382
5,899,089 A * 5/1999 Kwon ..... 62/408

FOREIGN PATENT DOCUMENTS

| | | |
|---|---|---|
| JP | 09113124 A * | 5/1997 |
| KR | 10-0189260 | 1/1999 |
| KR | 10-0498380 | 7/2005 |
| WO | WO 2004/038311 | 5/2004 |
| WO | WO 2004038311 A1 * | 5/2004 |

OTHER PUBLICATIONS

Translation of JP 09113124 A.*
Mexican Office Action dated Jun. 2, 2009.
Korean Office Action dated Jul. 28, 2006.
Mexican Office Action dated Aug. 8, 2009.

* cited by examiner

*Primary Examiner*—Cheryl J Tyler
*Assistant Examiner*—Justin Loffredo
(74) *Attorney, Agent, or Firm*—KED & Associates, LLP

(57) ABSTRACT

A cooling air supply apparatus of a refrigerator that is capable of uniformly supplying cooling air to all food received in a receiving box is disclosed. The refrigerator includes a refrigerating compartment and a freezing compartment for storing food at low temperature, a barrier for partitioning the refrigerating compartment and the freezing compartment from each other, and a receiving box mounted in the refrigerating compartment for receiving food. The cooling air supply apparatus includes a communication port formed through the barrier for guiding cooling air from the freezing compartment into the refrigerating compartment, and a hollow box-shaped cover mounted at the top part of the receiving box. The cover is provided at one side thereof with an introduction port, which communicates with the communication port. The cover is provided at the lower part thereof with at least one cooling air supplying hole, which communicates with the interior of the receiving box.

18 Claims, 18 Drawing Sheets

COOLING AIR SUPPLY APPARATUS OF REFRIGERATOR

This application claims the benefit of Korean Patent Application No. P2005-38233 and P2005-38234 filed on May 7, 2005, and P2005-41796 filed on May 18, 2005, and P2005-49864 and P2005-49865 filed on Jun. 10, 2005, which are hereby incorporated by reference as if fully set forth herein.

BACKGROUND OF THE INVENTION

1. Field of the Invention

The present invention relates to a cooling air supply apparatus of a refrigerator, and more particularly, to a cooling air supply apparatus of a refrigerator that is capable of efficiently supplying cooling air from a freezing compartment of the refrigerator to a receiving box formed in a refrigerating compartment of the refrigerator for storing vegetables and meat.

2. Discussion of the Related Art

Generally, a refrigerator is an electric appliance that stores food at relatively low temperature to prevent the food from rotting and to maintain the food in a fresh state. The refrigerator typically includes a refrigerating compartment for storing the food in a refrigerated state at above-zero low temperature (normally 0° C. to 8° C.) and a freezing compartment for storing the food in a frozen state at sub-zero low temperature (normally −20° C. to −0° C.)

In recent years, a side-by-side type refrigerator, wherein a refrigerating compartment and a freezing compartment are arranged in the width direction of the refrigerator in order to improve the receiving efficiency of the refrigerator, has been increasingly used. Even in this side-by-side type refrigerator, the refrigerating compartment and the freezing compartment, which are arranged in the width direction of the refrigerator, are partitioned from each other by a barrier in the same manner as conventional refrigerators.

Generally, it is preferable that some of food stored in the refrigerator, for example, vegetables and fruits, be stored at approximately 4° C. Also, it is preferable that vegetables and fruits be stored in the refrigerator in such a manner that the evaporation of moisture from the vegetables and the fruits can be effectively prevented in consideration of the characteristics of the vegetables and the fruits. To this end, an additional receiving box is mounted in a hermetically-sealed state at one side of the refrigerator for storing the vegetables and the fruits without loss of moisture.

Furthermore, in recent years, there has been developed a method of storing meat in the refrigerating compartment of the refrigerator in an unfrozen state, thereby insuring relatively minor deterioration of taste and nutriment, in addition to a conventional method of storing meat in the freezing compartment of the refrigerator in a frozen state such that the meat can be frozen at a low temperature of approximately 18° C. below zero.

In this method of storing the meat in the unfrozen state, the meat is stored at a temperature of approximately 1° C. below zero. Consequently, the method of storing the meat in the unfrozen state has an advantage in that not only the spoilage or deterioration of the meat is prevented but also the damage to taste and nutriment is minimized.

Hereinafter, a conventional side-by-side type refrigerator and a structure for supplying cooling air to a receiving box of the refrigerator will be described in brief with reference to FIGS. 1 to 3.

First, as shown in FIG. 1, a freezing compartment 11 and a refrigerating compartment 12 are arranged in a refrigerator body 10 in the width direction of the refrigerator. Between the refrigerating compartment 12 and the freezing compartment 11 is disposed a barrier 13, by which the refrigerating compartment 12 and the freezing compartment 11 are partitioned from each other.

Inside the refrigerating compartment 12 are mounted a plurality of receiving boxes 20, which can be moved in forward and backward directions of the refrigerator, i.e., to the outside and inside of the refrigerator body 10, such that food can be easily put into the receiving boxes 20 and food can be easily taken out of the receiving boxes 20. Each of the receiving boxes 20 has an open top part, which is covered by a corresponding one of shelves 30 that divide the refrigerating compartment into a plurality of refrigerating sections.

Consequently, while the interior of the refrigerating compartment 12 of the refrigerator body 10 is maintained at an appropriate temperature, i.e., approximately 4° C. above zero, the interior of each receiving box 20 is also maintained at approximately 4° C. above zero such that vegetables and fruits can be stored in a fresh state in each receiving box 20. At this time, when the open top part of each receiving box 20 is covered by the corresponding shelf 30, the evaporation of moisture from the vegetables and the fruits can be effectively prevented, and therefore, the vegetables and the fruits can be stored for a long period of time in a fresh state.

As described above, in recent years, there has been proposed a method of storing meat in any one of the receiving boxes 20 mounted in the refrigerating compartment 12 in an unfrozen state by supplying cooling air to the receiving box 20.

FIGS. 2 and 3 illustrate a conventional structure for selectively supplying cooling air from the freezing compartment to the receiving box 20 of the refrigerating compartment 12. Specifically, as shown in FIGS. 2 and 3, a communication port 40 is formed through the lower part of the barrier 13, which partitions the refrigerating compartment 12 and the freezing compartment 11 from each other, such that cooling air can be supplied from the freezing compartment 11 to the receiving box 20 mounted in the refrigerating compartment 12 through the communication port 40. As a result, the interior of the receiving box 20 can be maintained at a temperature of approximately 1° C. below zero, which is lower than the overall temperature of the refrigerating compartment 12, whereby meat can be stored in the unfrozen state.

The amount of cooling air passing through the communication port 40 is controlled by the adjustment of the open sectional area of the communication port 40, which is performed by the operation of a temperature control unit and a damper (not shown) of the refrigerating compartment 12.

The control of the amount of cooling air passing through the communication port 40 will be described in more detail below.

When a user puts meat into the receiving box 20, and manipulates a controller (not shown) such that the interior of the receiving box 20 can be maintained in an unfrozen state, i.e., at a temperature of approximately 1° C. below zero, the damper (not shown) formed at the communication port 40 is opened, and therefore, cooling air is supplied from the freezing compartment 11 to the refrigerating compartment 12 through the communication port 40.

The cooling air supplied through the communication port 40 is discharged into the refrigerating compartment 12, and then flows to one side of the receiving box 20. The cooling air having flowed to one side of the receiving box 20 subsequently flows to the upper and lower parts and front and rear parts of the receiving box 20 through a space defined between the receiving box 20 and the inner wall of the refrigerating compartment 12.

The cooling air flowing along the outside of the receiving box 20 is introduced into the receiving box 20 through cooling air supplying holes 20*a* formed in the side part or the rear part of the receiving box 20. As a result, the interior temperature of the receiving box 20 is lowered, and therefore, the meat received in the receiving box 20 is stored at a predetermined temperature, at which the meat is stored in an unfrozen state.

However, the conventional cooling air supply apparatus for supplying the cooling air from the freezing compartment 11 to the receiving box 20 of the refrigerating box 12 has the following problems.

First, when the cooling air flowing through the communication port 40 is supplied to one side of the receiving box 20, the supplied cooling air flows along the outside of the receiving box 20. At this time, heat transfer is carried out between a part of the cooling air and the air in the refrigerating compartment 12, which is higher than the cooling air. As a result, the cooling air is supplied into the receiving box 20 while the temperature of the cooling air slightly increases.

Consequently, there is generated a temperature variation between the temperature of the cooling air introduced through the cooling air supplying hole 20*a* relatively adjacent to the communication port 40 and the temperature of the cooling air introduced through the cooling air supplying hole 20*a* relatively far away from the communication port 40. As a result, the interior temperature of the receiving box 20 cannot be uniformly maintained, and therefore, the cooling efficiency in the receiving box 20 is lowered.

Secondly, the cooling air flowing through the communication port 40 is not directly supplied into the receiving box 20. The cooling air flowing through the communication port 40 collides with one side of the receiving box 20, and then flows along the outside of the receiving box 20. As a result, loss of cooling air is incurred, and the temperatures of other components in the vicinity of the receiving box 20 are also lowered.

For example, when cooling air having a temperature of approximately 7° C. below zero flows to the first part of the receiving box 20 through the communication port 40, beverages received inside a refrigerator door, which is disposed adjacent to the front part of the receiving box 20, may be frozen.

Thirdly, the cooling air flowing through the communication hole 40 is introduced into the receiving box 20 through a small number of cooling air supplying holes 20*a* formed at predetermined positions of the side part and rear part of the receiving box 20. As a result, food received in the receiving box 20 while being adjacent to the cooling air supplying holes 20*a* is greatly affected by the cooling air, but food received in the receiving box 20 while being far away from the cooling air supplying holes 20*a* is slightly affected by the cooling air. Consequently, it is difficult to uniformly store food in the receiving box 20.

SUMMARY OF THE INVENTION

Accordingly, the present invention is directed to a cooling air supply apparatus of a refrigerator that substantially obviates one or more problems due to limitations and disadvantages of the related art.

An object of the present invention is to provide a cooling air supply apparatus of a refrigerator that is capable of uniformly supplying cooling air to all food received in a receiving box.

Another object of the present invention is to provide a cooling air supply apparatus of a refrigerator that is capable of supplying cooling air from a freezing compartment into a receiving box without outflow of the cooling air to the outside of the receiving box, thereby preventing loss of cooling air and the increase of temperature, and minimizing affect on other components in a refrigerating compartment due to the outflow of the cooling air.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooling air supply apparatus of a refrigerator, which includes a refrigerating compartment and a freezing compartment for storing food at low temperature, a barrier for partitioning the refrigerating compartment and the freezing compartment from each other, and a receiving box mounted in the refrigerating compartment for receiving food, includes a communication port formed through the barrier for guiding cooling air from the freezing compartment into the refrigerating compartment, and a hollow box-shaped cover mounted at the top part of the receiving box, the cover being provided at one side thereof with an introduction port, which communicates with the communication port, the cover being provided at the lower part thereof with at least one cooling air supplying hole, which communicates with the interior of the receiving box.

In another aspect of the present invention, a cooling air supply apparatus of a refrigerator, which includes a refrigerating compartment and a freezing compartment for storing food at low temperature, a barrier for partitioning the refrigerating compartment and the freezing compartment from each other, and a receiving box mounted in the refrigerating compartment for receiving food, includes a communication port formed through the barrier for guiding cooling air from the freezing compartment into the refrigerating compartment, and a cover mounted for covering the top part of the receiving box, the cover being provided at one side thereof with an introduction port, which communicates with the communication port, the cover being provided at another side thereof with a discharge port, through which the cooling air introduced through the introduction port is discharged.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First, a cooling air supply apparatus of a refrigerator according to a first preferred embodiment of the present invention will be described with reference to FIGS. 4 and 5.

Figure 1:
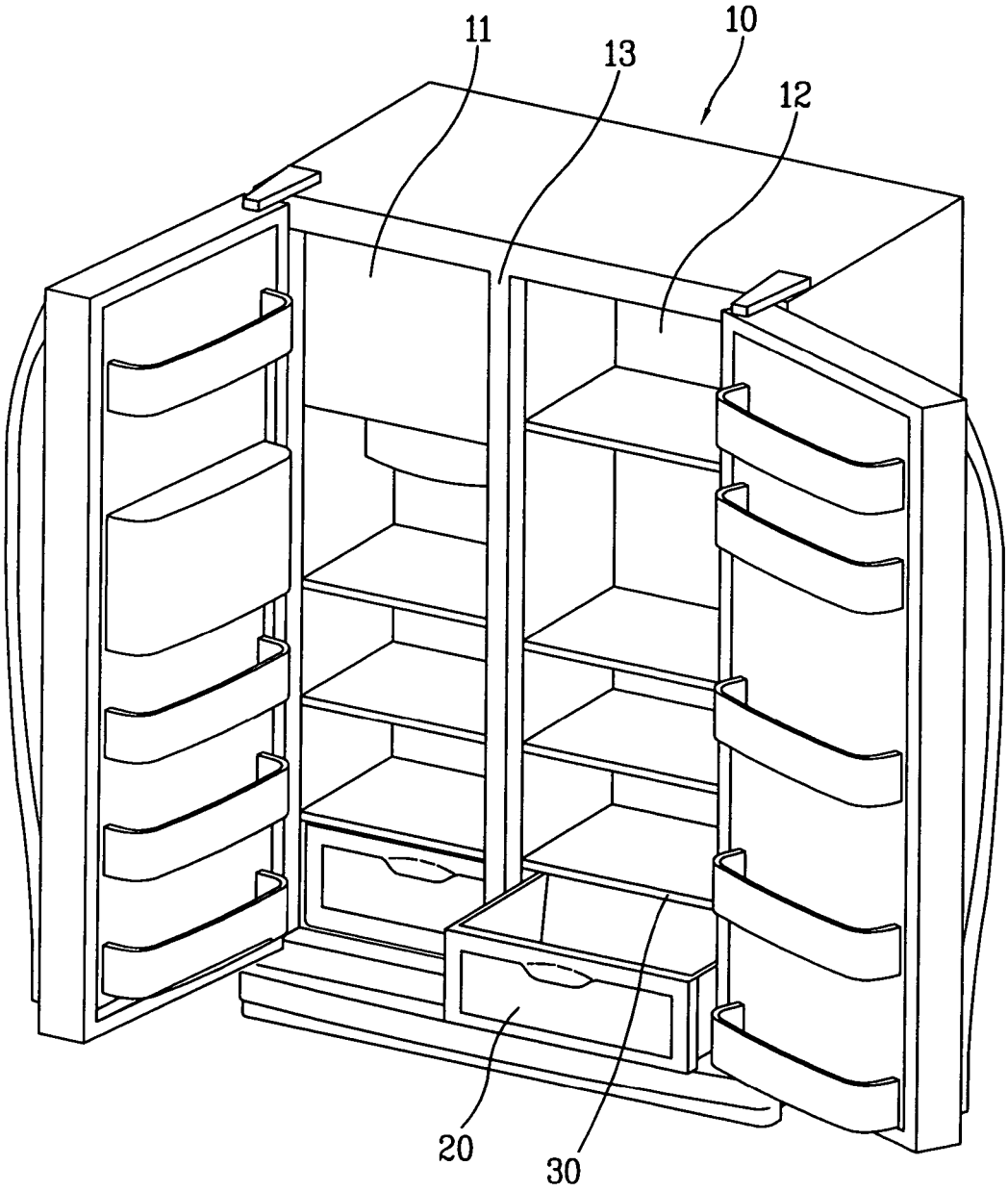
FIG. 1 is a perspective view illustrating a general side-by-side type refrigerator.
Figure 2:
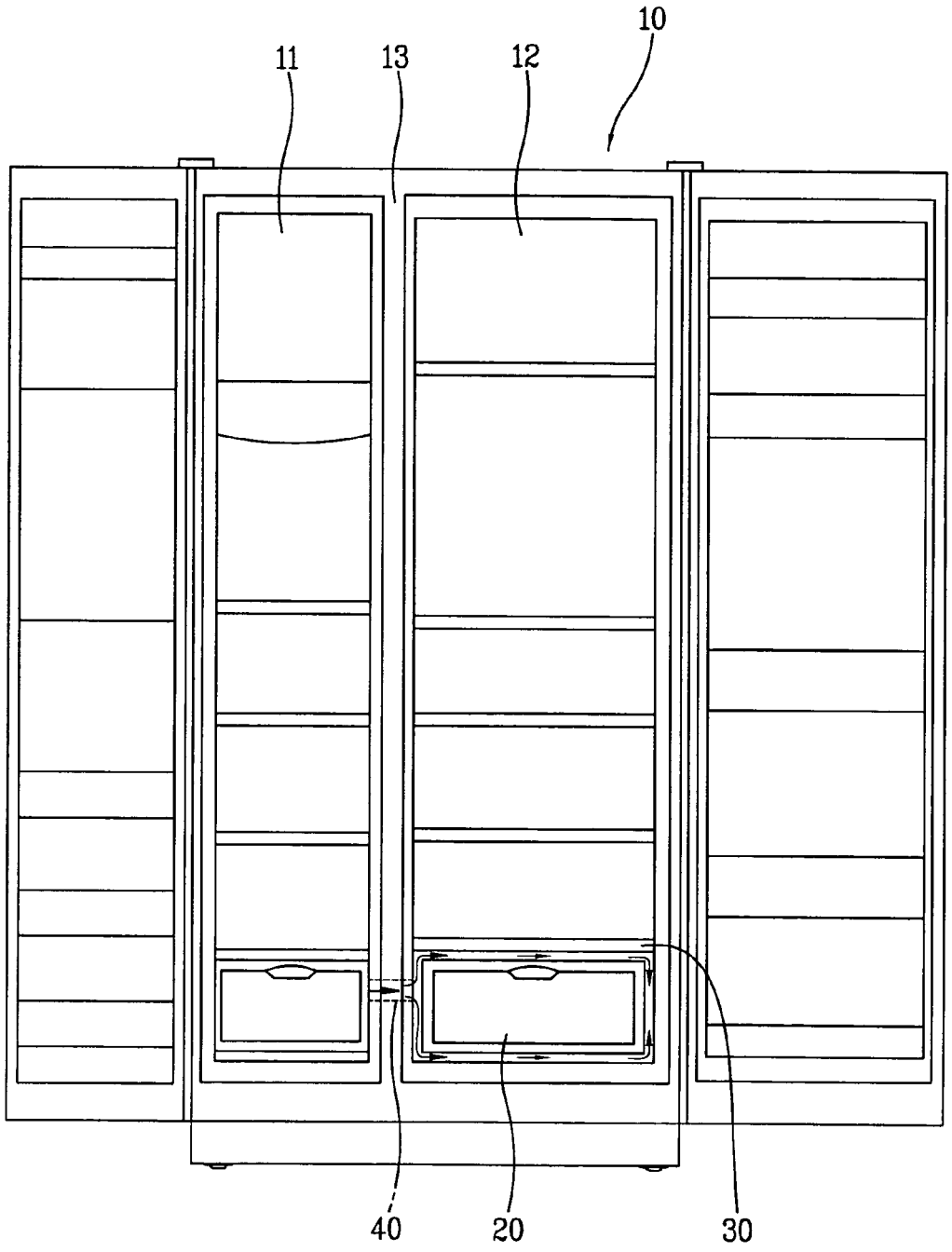
FIG. 2 is a front view of the refrigerator shown in FIG. 1 with doors of the refrigerator being opened.
Figure 3:
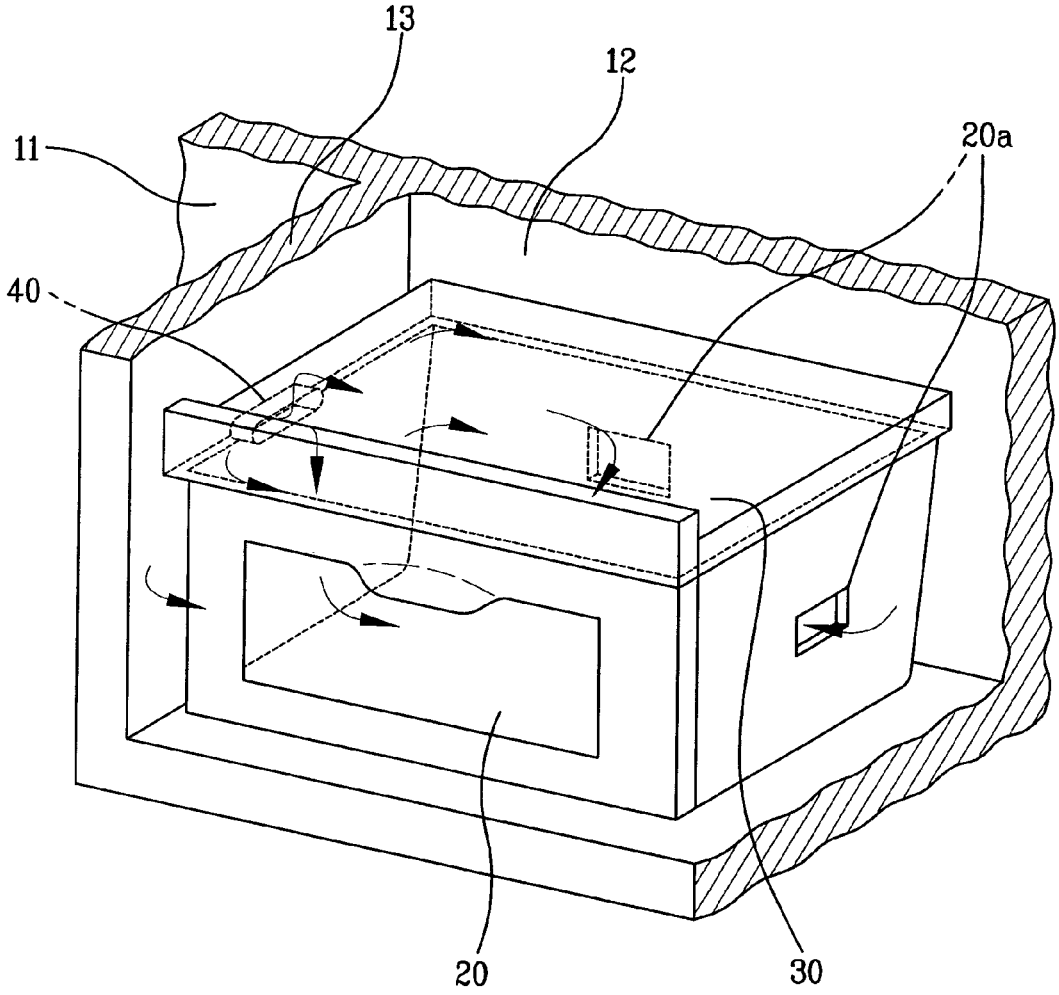
FIG. 3 is a perspective view illustrating the structure of a conventional cooling air supply apparatus.
Figure 4:
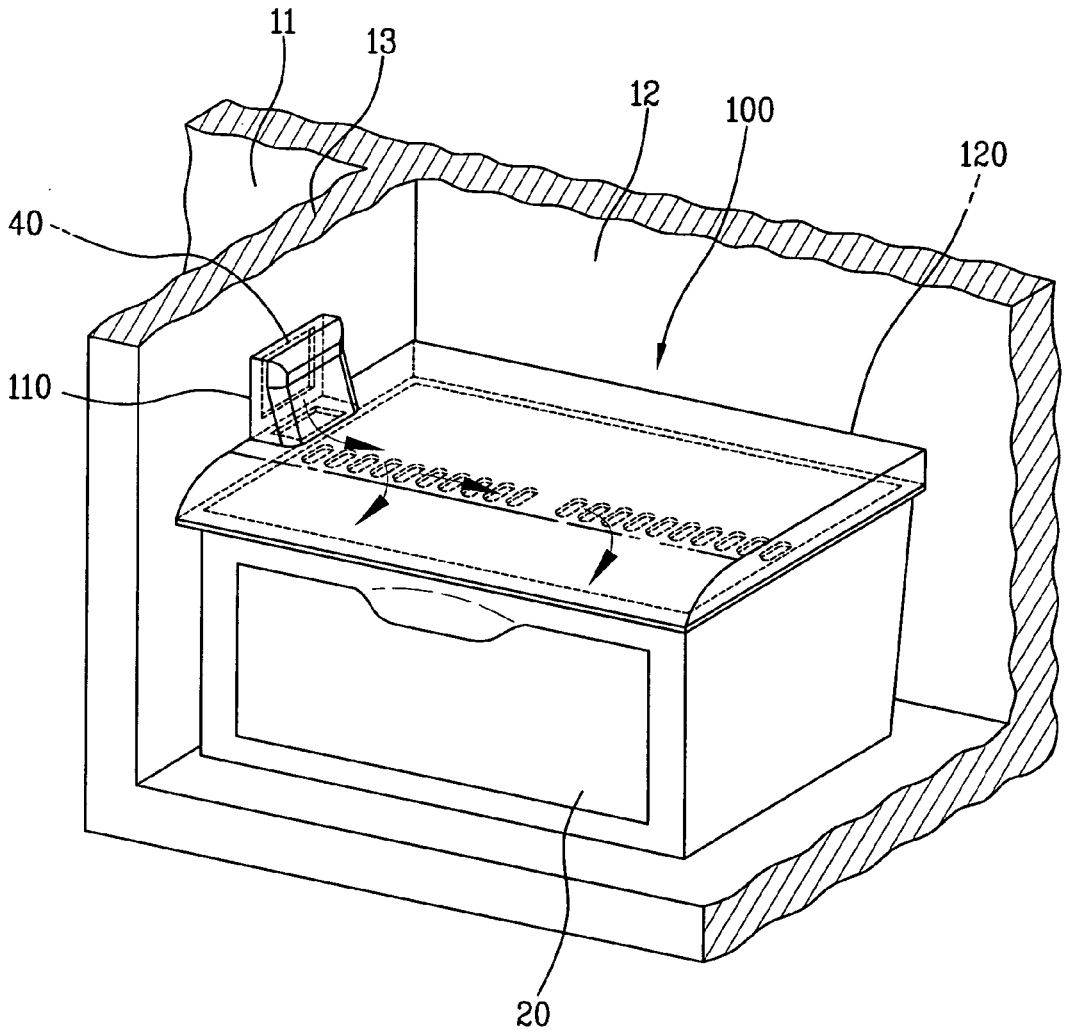
FIG. 4 is a perspective view illustrating the structure of a cooling air supply apparatus according to a first preferred embodiment of the present invention.

As shown in FIG. 4, a barrier 13 is disposed between a refrigerating compartment 12 and a freezing compartment 11. Through the barrier 13 is formed a communication port 40, which serves to guide cooling air from the freezing compartment 11 into the refrigerating compartment 12. Although not shown in the drawing, a damper (not shown), which serves to control the supply of cooling air from the freezing compartment 11 to the refrigerating compartment 12, is preferably mounted at the communication port 40. The opening level of the damper (not shown) is controlled by a controller (not shown) of the refrigerator, whereby the amount of cooling air supplied is appropriately controlled.

Inside the refrigerating compartment 12 is mounted a receiving box 20, which receives food, such as meat or vegetables, such that the receiving box 20 can be moved in forward and backward directions of the refrigerator, i.e., to the outside and inside of the refrigerating compartment 12. The receiving box 20 has an open top part.

At the top part of the receiving box 20 is mounted a cooling air supply apparatus 100 for covering the open top part of the receiving box 20 and for directly supply cooling air from the freezing compartment 11 into the receiving box 20.

Figure 5:
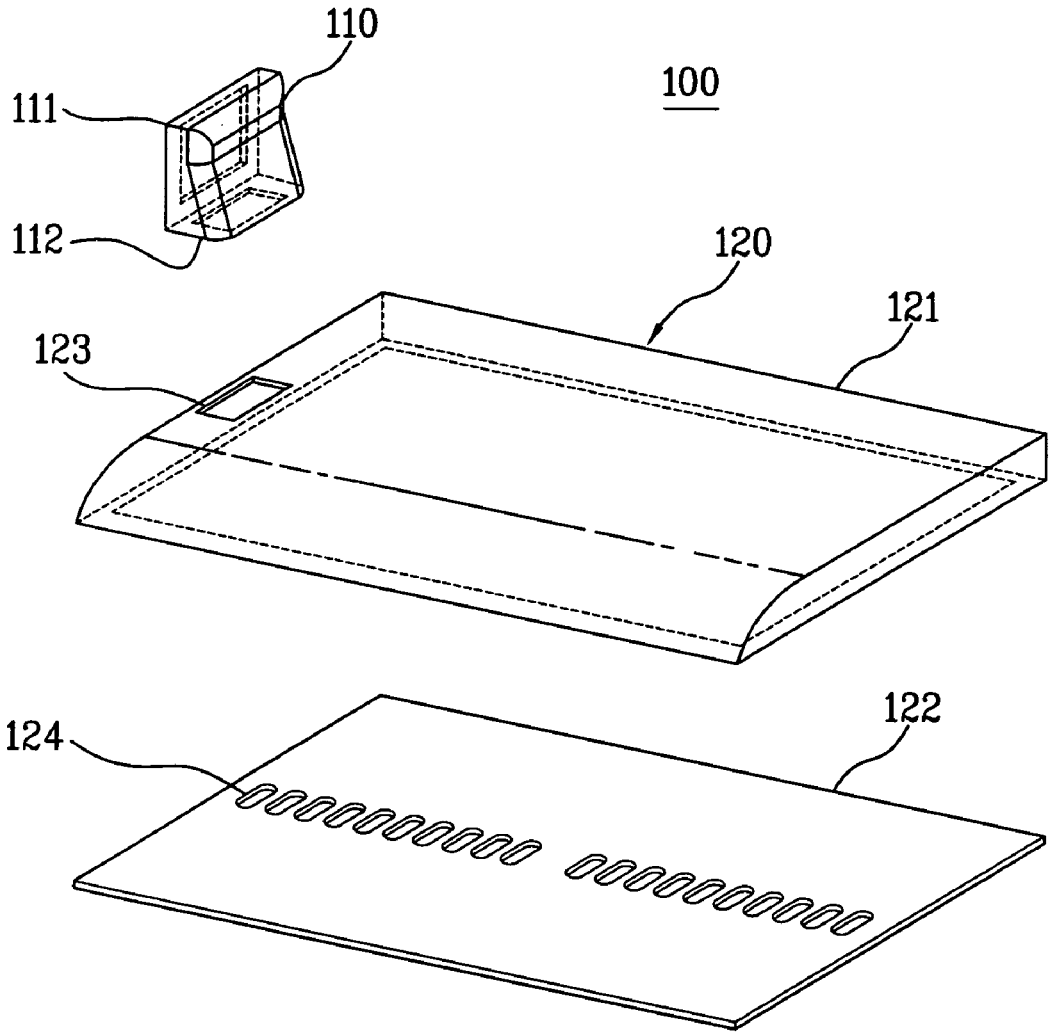
FIG. 5 is an exploded perspective view of the cooling air supply apparatus shown in FIG. 4.

As shown in FIGS. 4 and 5, the cooling air supply apparatus 100 includes a duct 110 for guiding the cooling air supplied through the communication port 40 to the receiving box 20, and a cover 120 for supplying the cooling air guided through the duct 110 into the receiving box 20.

The duct 110 is provided at one surface thereof, which is connected to the communication port 40, with an inlet port 111, which is formed in the same shape as the opening of the communication port 40. In addition, the duct 110 is provided at one surface thereof, which is connected to the cover 120, with an outlet port 112, which communicates with an introduction port 123 formed at one side of the cover 120.

The cover 120 is formed in the shape of a thin hollow box, the interior of which is hollow such that the cooling air supplied through the duct 110 can flow along the hollow interior. The cover 120 serves to supply the cooling air guided through the duct 110 into the receiving box 20. In addition, the cover 120 serves to cover the open top part of the receiving box 20 as a shelf.

In this embodiment, the cover 120 includes an upper plate 121 formed in the shape of a thin box having an open bottom part, and a lower plate 122 formed in the shape of a flat board. The lower plate 122 is coupled to the upper plate 121 for covering the open bottom part of the upper plate 121.

Of course, the upper plate 121 and the lower plate 122 may be integrally manufactured by injection molding, although the upper plate 121 and the lower plate 122 are separately manufactured in this embodiment.

As described above, the introduction port 123 is formed at one side of the upper part of the upper plate 121 such that the introduction port 123 communicates with the outlet port 112 of the duct 110.

Through the lower plate 122 are formed a plurality of cooling air supplying holes 124, through which the cooling air introduced into the inner space of the cover 120 through the introduction port 123 is discharged into the receiving box 20. Preferably, the plurality of cooling air supplying holes 124 are uniformly arranged over the entire surface of the lower plate 122 such that the cooling air can be uniformly supplied into the receiving box 20 through the cooling air supplying holes 124. In this embodiment, the cooling air supplying holes 124 are arranged in a line along the direction where the cooling air introduced through the introduction port 123 flows due to flow pressure, i.e., from one side part of the cover 120 at which the introduction port 123 is formed to the opposite side part. Although the cooling air supplying holes 124 are arranged in a line in this embodiment, the cooling air supplying holes 124 may be arranged in two or more lines. Alternatively, the cooling air supplying holes 124 may be arranged in a zigzag fashion or an irregular fashion.

Also, the number, the shape, and the size of the cooling air supplying holes 124 may be appropriately changed depending upon the amount of cooling air supplied into the receiving box 20. For example, the number or the size of the cooling air supplying holes 124 may be small at the part where the cooling air is directly introduced, and the number or the size of the cooling air supplying holes 124 may be large at the opposite part, i.e., at the part where the cooling air is not directly introduced.

The cooling air supply apparatus with the above-stated construction according to the present invention is operated as follows.

A user puts food, such as meat, to be stored at a temperature lower than the interior temperature of the refrigerating compartment 12 into the receiving box 20, and establishes the interior temperature of the receiving box 20 through the controller (not shown). As a result, the damper (not shown) mounted at the communication port 40 is opened, and therefore, cooling air is supplied from the freezing compartment 11 into the refrigerating compartment 12 through the communication port 40. The cooling air supplied through the communication port 40 is guided into the duct 110 through the inlet port 111 of the duct 110.

The cooling air guided into the duct 110 is introduced into the inner space of the cover 120 through the outlet port 112 of the duct 110 and the introduction port 123 of the cover 120.

The cooling air introduced into the inner space of the cover 120 is supplied into the receiving box 20 through the cooling air supplying holes 124 formed at the lower plate 122 of the cover 120.

At this time, since the cooling air supplying holes 124 are arranged at regular intervals from one end to the other end of the lower plate 122, the cooling air is uniformly supplied into the receiving box 20.

The food, such as meat, received in the receiving box 20 is cooled to an appropriate temperature by the cooling air supplied into the receiving box 20 through the cooling air supplying holes 124 of the cover 120.

When the interior temperature of the receiving box 20 has reached a predetermined temperature level or when a predetermined period of time has elapsed, the controller closes the damper (not shown) or reduces the opening degree of the damper. As a result, the communication port 40 is closed, or the amount of cooling air supplied is reduced.

Figure 6:
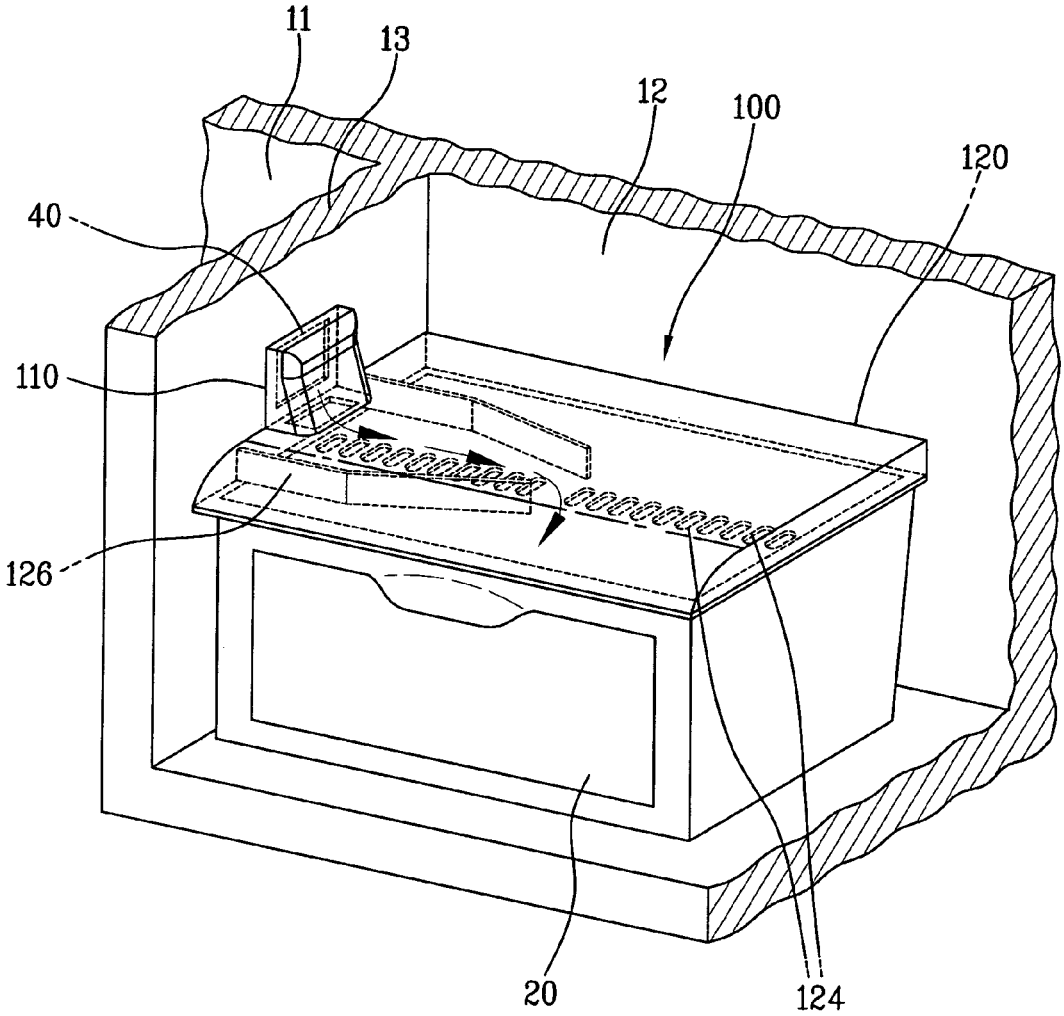
FIG. 6 is a perspective view illustrating the structure of a cooling air supply apparatus according to a second preferred embodiment of the present invention.
Figure 7:
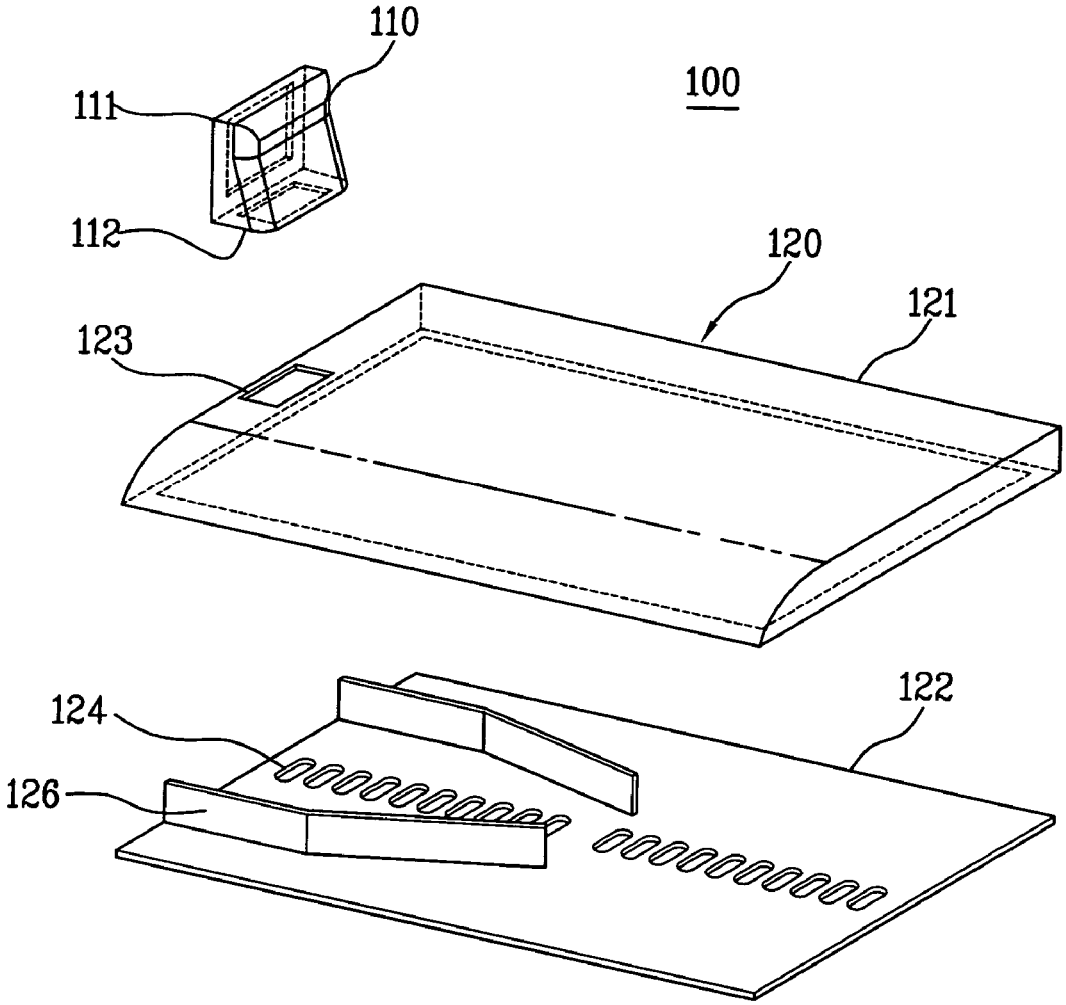
FIG. 7 is an exploded perspective view of the cooling air supply apparatus shown in FIG. 6.

FIGS. 6 and 7 illustrate a cooling air supply apparatus according to a second preferred embodiment of the present invention. The cooling air supply apparatus according to the second preferred embodiment of the present invention is identical in basic construction to the cooling air supply apparatus according to the previously described first preferred embodiment of the present invention. However, the cooling air supply apparatus according to the second preferred embodiment of the present invention is different from the cooling air supply apparatus according to the previously described first preferred embodiment of the present invention in that the cooling air supply apparatus according to the second preferred embodiment of the present invention further includes a pair of guide ribs 126 formed at the inside of the cover 120, such that the guide ribs 126 are opposite to each other, for guiding the cooling air introduced through the duct 110.

The guide ribs 126 are mounted to the lower plate 122 of the cover 120 such that the guide ribs 126 protrude upward from the lower plate 122. The guide ribs 126 extend toward the center of the lower plate 122 from one side end of the lower plate 122 at which the upper plate 121 is connected to the duct 110. Also, the guide ribs 126 are preferably arranged such that the guide ribs 126 can gradually converge upon the center of the lower plate 122.

Preferably, the guide ribs 126 are disposed such that the guide ribs 126 are almost connected to the bottom part of the upper plate 121, whereby the cooling air introduced through the introduction port 123 is guided without outflow of the cooling air to the outside of the guide ribs 126.

Of course, the guide ribs 126 may be integrally formed at the upper plate 121, although the guide ribs 126 are formed at the lower plate 122 in this embodiment.

Alternatively, the guide ribs 126 may be separately manufactured from the lower plate 122 or the upper plate 121 such that guide ribs 126 can be coupled later to the lower plate 122 or the upper plate 121.

When the guide ribs 126 are formed at the inside of the cover 120 as described above, the cooling air supplied into the introduction port 123 through the duct 110 is not widely propagated in the lateral direction but smoothly flows along the direction in which the cooling air supplying holes 124 are arranged by the guidance of the guide ribs 126. As a result, the cooling air can be more smoothly supplied into the receiving box 20 through the cooling air supplying holes 124.

Meanwhile, the cooling air supply apparatuses according to the previously described embodiments of the present invention are constructed such that the amount of cooling air supplied into the receiving box 20 is controlled by the damper (not shown) mounted at the communication port 40.

However, the amount of cooling air supplied through the communication port 40 may be controlled manually or automatically.

Figure 8:
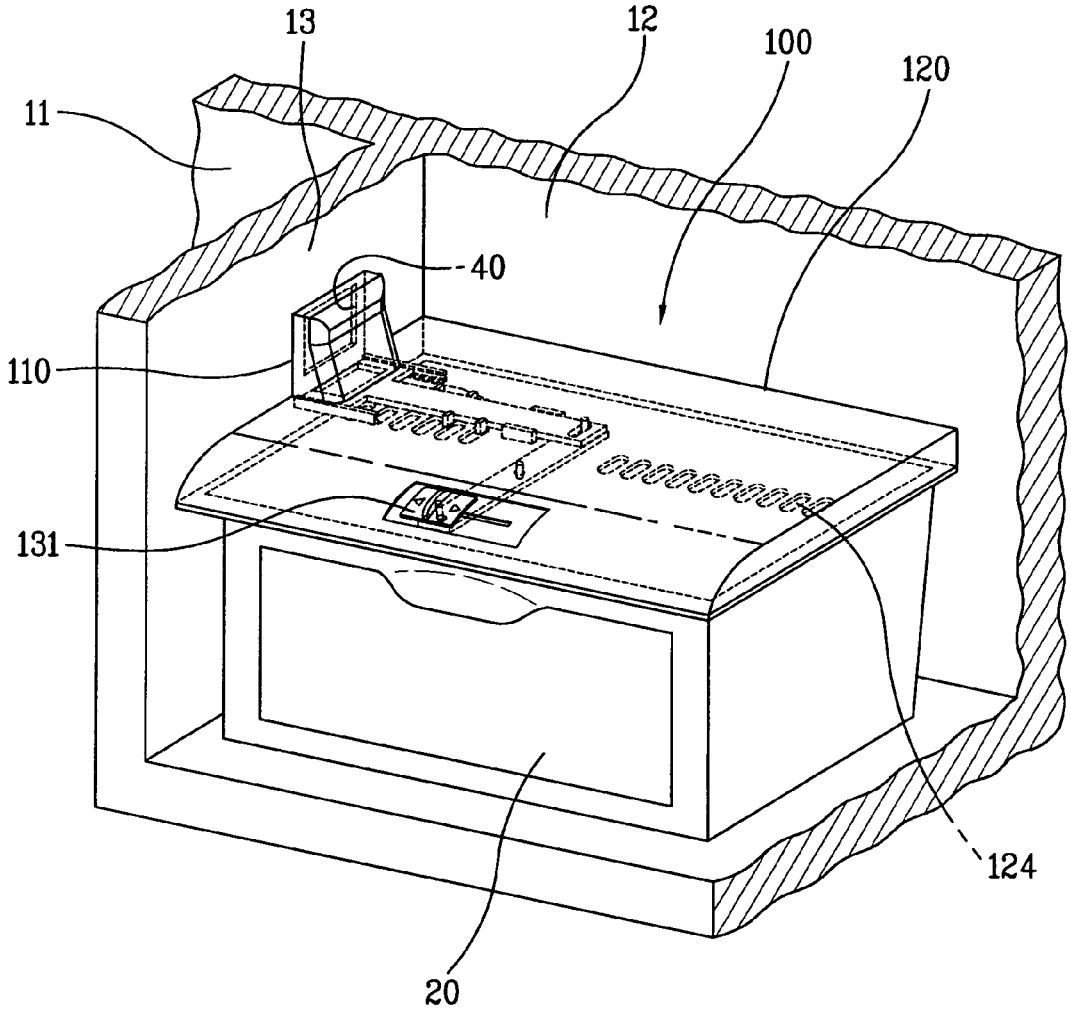
FIG. 8 is a perspective view illustrating the structure of a cooling air supply apparatus according to a third preferred embodiment of the present invention.
Figure 9:
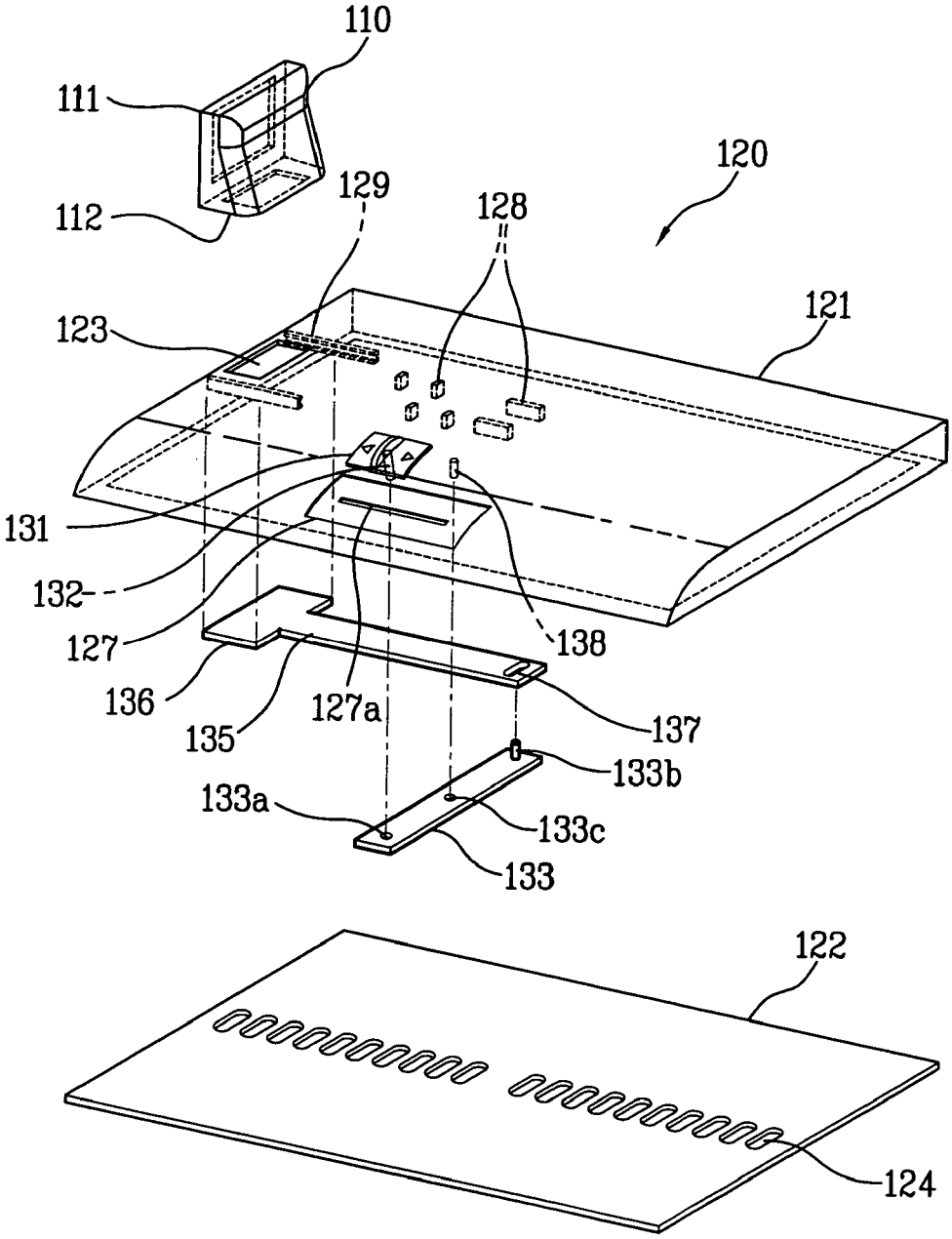
FIG. 9 is an exploded perspective view of the cooling air supply apparatus shown in FIG. 8.
Figure 10:
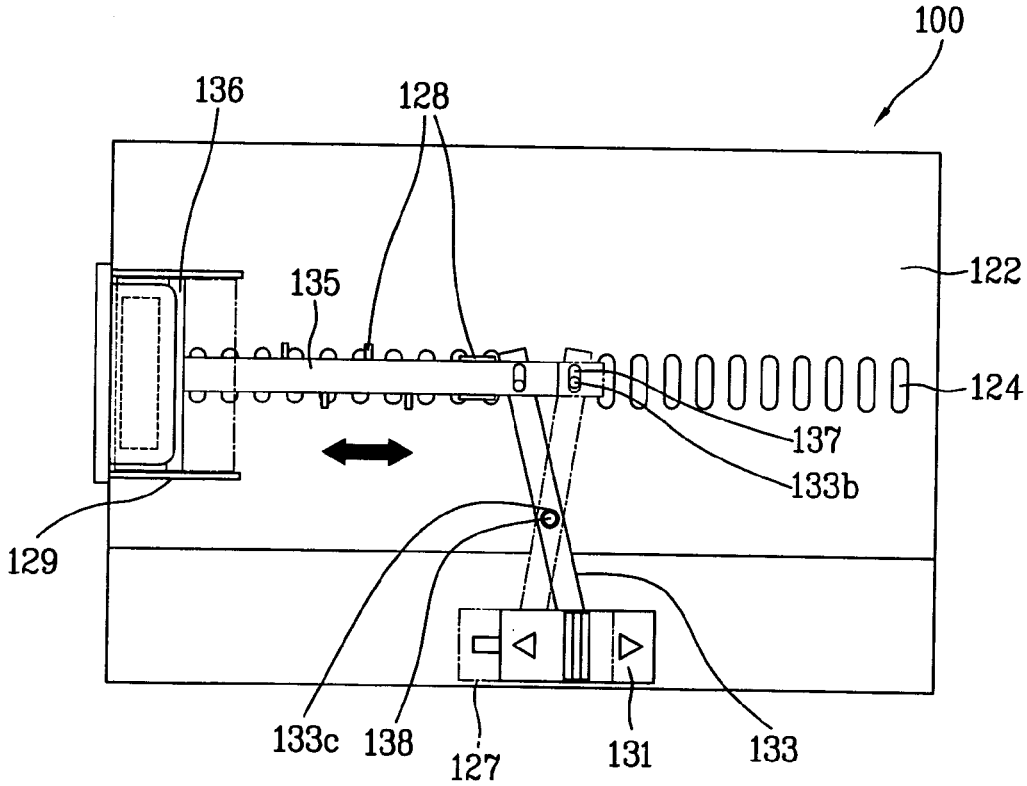
FIG. 10 is a plan view illustrating the operation of the cooling air supply apparatus shown in FIG. 8.

FIGS. 8 to 10 illustrate a cooling air supply apparatus having a cooling air control function according to a third preferred embodiment of the present invention.

The cooling air supply apparatus according to the third preferred embodiment of the present invention includes a duct 110, a cover 120, and a cooling air amount control unit. The principal constructions of the duct 110 and the cover 120 according to the third preferred embodiment of the present invention are almost identical to those of the duct 110 and the cover 120 according to the previously described first preferred embodiment of the present invention except that the cover 120 according to the third preferred embodiment of the present invention includes additional components necessary for constructing the cooling air amount control unit, which will be described in detail below.

The cooling air amount control unit includes a handle 131, a pivoting bar 133, a linear moving bar 135, and a blocking plate 136.

The handle 131 is a plate-shaped member which can be manipulated by a user. In this embodiment, the handle 131 is disposed in a guide groove 127 concavely formed at the center of the front curved surface of the upper plate 121 such that the handle 131 can be moved from side to side along the guide groove 127.

Preferably, a mark indicating the amount of cooling air supplied according to the manipulation of the handle 131 is formed on the upper surface of the handle 131.

At the lower surface of the handle 131 is formed a guide pin 132, which protrudes downward from the lower surface of the handle 131. The guide pin 132 is securely fitted in a coupling hole 133*a* formed at one end of the pivoting bar 133.

Also, the guide pin 132 is inserted through a guide slit 127*a* formed at the guide groove 127 of the upper plate 121 such that the guide slit 127*a* extends from side to side. Consequently, when the user moves the handle 131 from side to side, the guide pin 132 is moved from side to side along the guide slit 127*a* to guide the movement of the handle 131.

The pivoting bar 133 is a bar extending from the lower part of the handle 131 to one end of the linear moving bar 135. At one end of the pivoting bar 133 is formed the coupling hole 133*a*, in which is pivotably coupled the guide pin 132 of the handle 131. At the other end of the pivoting bar 133 is formed a connection pin 133*b*, which protrudes upward. The connection pin 133*b* is inserted in an elongated hole 137 formed at one end of the linear moving bar 135. At the middle part of the pivoting bar 133 is formed a shaft hole 133*c*, in which a rotary shaft 138 of the cover 120 is inserted.

Consequently, when the handle 131 is moved from side to side, the pivoting bar 133 is rotated in a pivoting fashion by a predetermined angle from side to side about the rotary shaft 138. As a result, the linear moving bar 135, which is connected to the pivoting bar 133, is linearly moved from side to side.

In this embodiment, the rotary shaft 138, which is inserted in the shaft hole 133*c* of the pivoting bar 133, is formed at the upper plate 121 of the cover 120. Alternatively, the rotary shaft 138 may be formed at the lower plate 122 of the cover 120.

The linear moving bar 135 is disposed at one side of the cover 120 such that the linear moving bar 135 can be linearly reciprocated from side to side. At one end of the linear moving bar 135 is formed the blocking plate 136, which opens and closes the introduction port 123 of the cover 120. At the other end of the linear moving bar 135 is formed the elongated hole 137, in which the connection pin 124 of the pivoting bar is inserted.

At the lower surface of the upper plate 121 of the cover are formed a plurality of guide protrusions 128 and guide rails 129 for guiding the from-side-to-side linear movement of the linear moving bar 135. The guide rails 129 are disposed at the front and rear ends of the introduction port 123 while the guide rails 129 are arranged in parallel with each other. The guide rails 129 are formed approximately in the sectional shape of an "L" or an "[" such that the front and rear ends of the blocking plate 136 can be inserted between the guide rails 129 and guided along the guide rails 129.

The operation of the cooling air amount control unit with the above-stated construction will be described with reference to FIG. 10.

When a user wishes to control the interior temperature of the receiving box 20 or control the amount of cooling air to be supplied into the receiving box 20 according to the characteristics of food received in the receiving box 20, he/she pushes the handle 131 to the left or to the right. As a result, the handle 131 is moved along the guide groove 127 in the longitudinal direction of the guide groove 127.

At this time, the guide pin 132 formed at the lower surface of the handle 131 is moved along the guide slit 127*a*. As a result, the pivoting bar 133 is pivoted in a pivoting fashion about the rotary shaft 138 along the movement direction of the handle 131.

As the pivoting bar 133 is rotated in the pivoting fashion, the linear moving bar 135, which is connected to the end of the pivoting bar 133, is linearly moved in the direction opposite to the movement direction of the handle 131. At this time, the movement of the linear moving bar 135 is guided by the guide protrusions 128. Meanwhile, when the pivoting bar 133 is rotated in the pivoting fashion, the movement of the connection pin 133*b* forms a circular track. However, since the connection pin 133*b* of the pivoting bar 133 is inserted in the elongated hole 131 of the linear moving bar 135, the pivoting-fashion rotary movement of the pivoting bar 133 is converted into the linear movement of the linear moving bar 135.

As the linear moving bar 135 is moved, the blocking plate 136 is moved along the guide rails 129. As the result of the movement of the blocking plate 136, the opening level of the introduction port 123 is controlled, and therefore, the amount of cooling air supplied into the inner space of the cover 120 is controlled.

When the cooling air supply apparatus is equipped with the cooling air amount control unit as described above, it is possible to easily control the supply of cooling air from the freezing compartment 11 into the receiving box 20 of the refrigerating compartment 12 without the provision of the damper (not shown) at the communication port 40.

Figure 11:
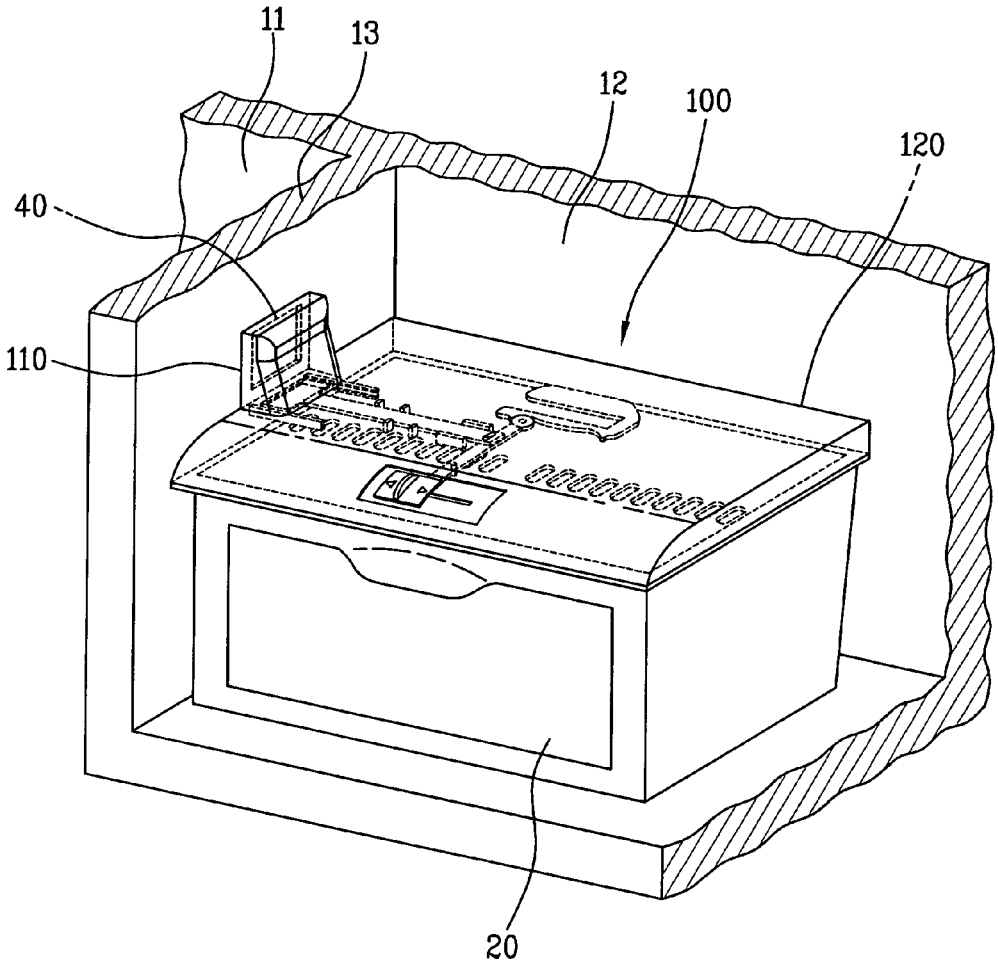
FIG. 11 is a perspective view illustrating the structure of a cooling air supply apparatus according to a fourth preferred embodiment of the present invention.
Figure 12:
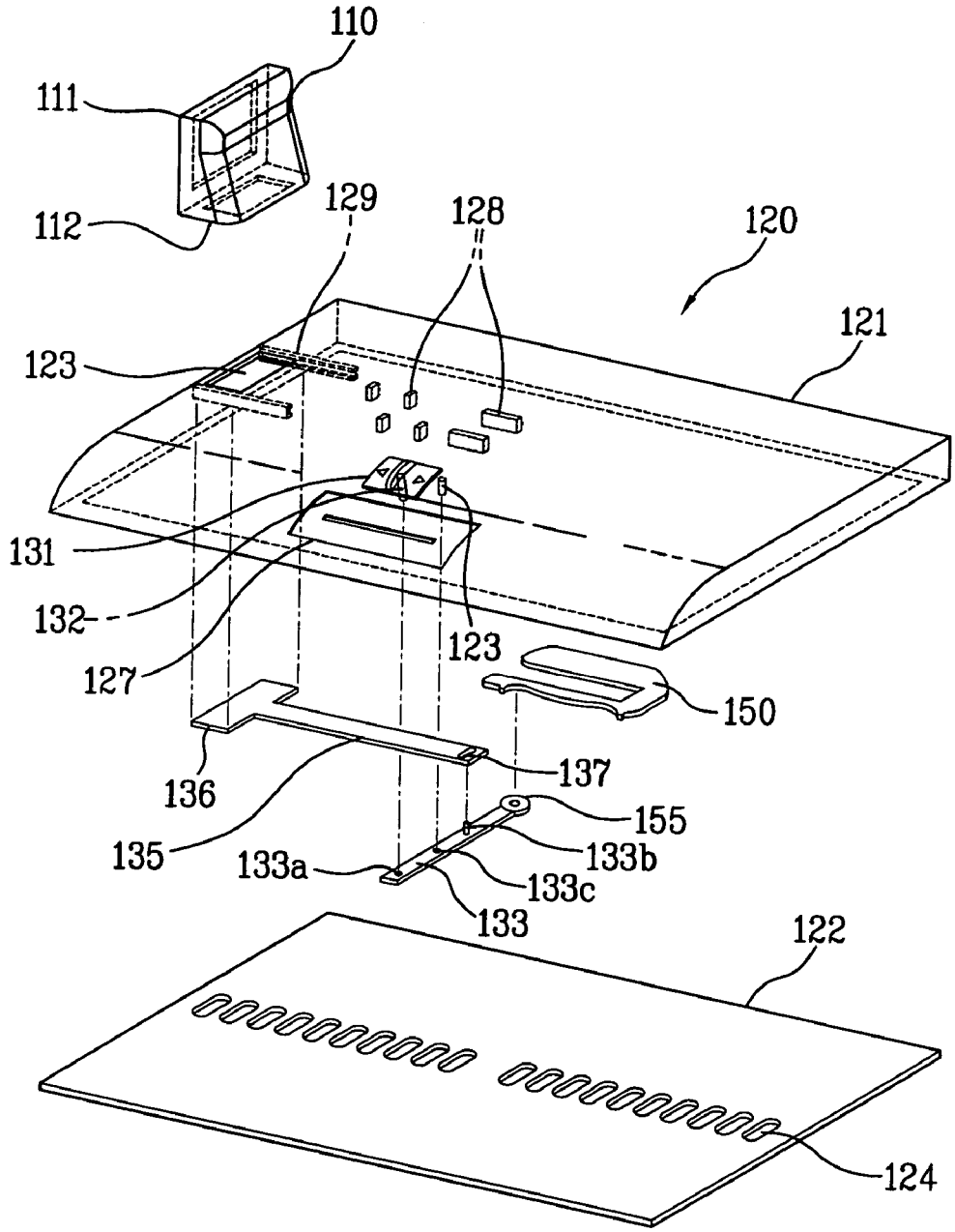
FIG. 12 is an exploded perspective view of the cooling air supply apparatus shown in FIG. 11.
Figure 13:
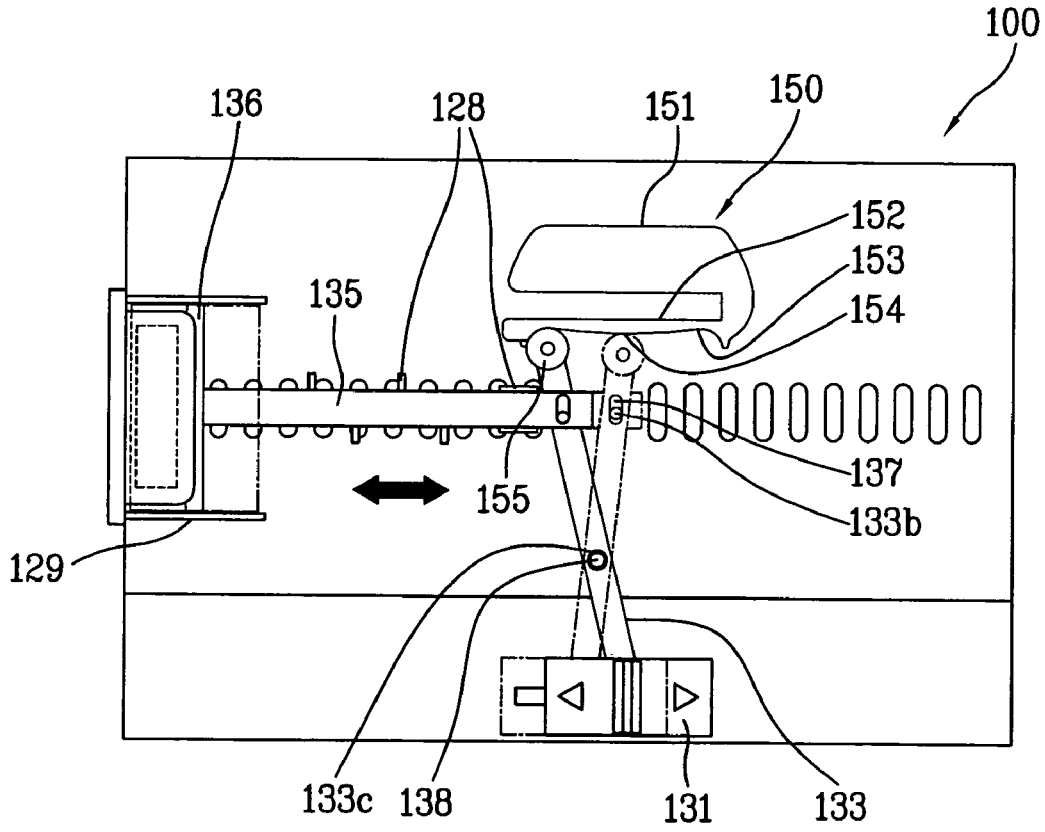
FIG. 13 is a plan view illustrating the operation of the cooling air supply apparatus shown in FIG. 11.

FIGS. 11 to 13 illustrate a cooling air supply apparatus according to a fourth preferred embodiment of the present invention. The cooling air supply apparatus according to the fourth preferred embodiment of the present invention is characterized by the modification of the cooling air amount control unit of the cooling air supply apparatus according to the third preferred embodiment of the present invention as shown in FIGS. 8 to 10.

The cooling air amount control unit of the cooling air supply apparatus according to the fourth preferred embodiment of the present invention is identical in basic construction to the cooling air amount control unit of the cooling air supply apparatus according to the previously described third preferred embodiment of the present invention except that the cooling air amount control unit according to the fourth preferred embodiment of the present invention further includes a position holding unit for maintaining the controlled state of the amount of cooling air.

Specifically, the cooling air amount control unit according to the fourth preferred embodiment of the present invention includes a handle 131, a pivoting bar 133, a linear moving bar 135, and a position holding unit for holding the position of the linear moving bar 135. The handle 131, the pivoting bar 133, and the linear moving bar 135 are identical in construction and operation to those of the cooling air amount control unit according to the previously described third preferred embodiment of the present invention, and therefore, the detailed descriptions thereof will not be given.

The position holding unit includes a curved portion 155 formed at the end of the pivoting bar 133, and a position holding plate 150, which elastically contacts the curved portion 155 to hold the pivoting position of the pivoting bar 133.

The position holding plate 150 includes a plate-shaped body 151, and an elastic portion 152, which elastically contacts the curved portion 155 such that the elastic portion 152 can be elastically moved by the movement of the curved portion 155.

The surface of the elastic portion 152 contacting the curved portion 155 of the pivoting bar 133 is formed in a curved concave-convex shape. Hereinafter, the concave parts formed at opposite sides of the elastic portion 152 will be referred to as "seating parts 153," and the convex part formed at the middle of the elastic portion 152 will be referred to as a "urging part 154." In this embodiment, two seating parts 153 are formed at the elastic portion 152, although three or more seating parts 153 may be provided by forming the surface of the elastic portion 152 contacting the curved portion 155 in the shape of a wave.

The plate-shaped body 151 is fixed to the inner surface of the upper plate 121 or the lower plate 122 of the cover 120 by means of fixing members, such as screws. In this embodiment, the body 151 is fixed to the inner surface of the upper plate 121.

The elastic portion 152 is a plate-shaped member, which is spaced a predetermined distance from the body 151. The elastic portion 152 is integrally connected to one side end of the body 151 such that the elastic portion 152 can be elastically moved between the body 151 and the pivoting bar 133.

Consequently, when the user moves the handle 131 from side to side in order to control the amount of cooling air introduced into the receiving box 20, the pivoting bar 133 is rotated in a pivoting fashion about the rotary shaft 138. As a result, the curved portion 155 formed at the end of the pivoting bar 133 is moved while the curved portion 155 is elastically contacting the elastic portion 152 of the position holding plate 150.

For example, as shown in FIG. 13, when the user wishes to move the blocking plate 136 so as to the open the introduction port 123, he/she moves the handle 131 from the right to the left on the drawing. As a result, the end of the pivoting bar 133 is rotated in a pivoting fashion in the clockwise direction, and therefore, the linear moving bar 135 is moved to the right on the drawing. Consequently, the introduction port 123 is opened by the blocking plate 136. At this time, the curved portion 155 passes by the urging part 154 from the left seating part 153 of the elastic portion 152. As a result, the curved portion 155 elastically presses the elastic portion 152 such that the elastic portion 152 can be moved toward the body 151. After that, the curved portion 155 is moved to the right seating part 153. Subsequently, the curved portion 155 is located in the right seating part 153, and, at the same time, the elastic portion 152 is returned to its original position. As a result, the position of the curved portion 155 is held, whereby the open state of the introduction port 123 accomplished by the blocking plate 136 is maintained.

When the user moves the handle 131 in the reverse direction, on the other hand, the pivoting bar 133 and the linear moving bar 135 are moved in the reverse fashion. As a result, the introduction port 123 is closed by the blocking plate 136.

In the case that three or more seating parts 153 are formed at the elastic portion 152 of the position holding plate 150, it is possible to hold the blocking plate 136 at three or more different positions, and therefore, to maintain the opening degree of the introduction port 123 in the state that the opening degree of the introduction port 123 is controlled.

In this embodiment, the curved portion 155 is integrally formed at the end of the pivoting bar 133. However, a cylindrical member, such as a roller, may be rotatably mounted to the end of the pivoting bar 133. In this case, when the pivoting bar 133 is moved, the movement of the pivoting bar 133 is more smoothly accomplished by virtue of the rolling movement of the roller.

Meanwhile, the cooling air supply apparatuses 100 according to the previously described first to fourth preferred embodiments of the present invention are constructed such that the cooling air supply apparatuses 100 directly supply cooling air from the freezing compartment 11 into the receiving box 20 to store food received in the receiving box 20 at low temperature.

Alternatively, as shown in FIGS. 14 to 18, the cooling air supply apparatus may be constructed such that the cooling air from the freezing compartment is not directly supplied into the receiving box but is guided along the outside of the receiving box, whereby food received in the receiving box is stored at a temperature lower than the interior temperature of the refrigerating compartment without loss of moisture. In this case, the receiving box is constructed in a hermetically sealed structure.

Figure 14:
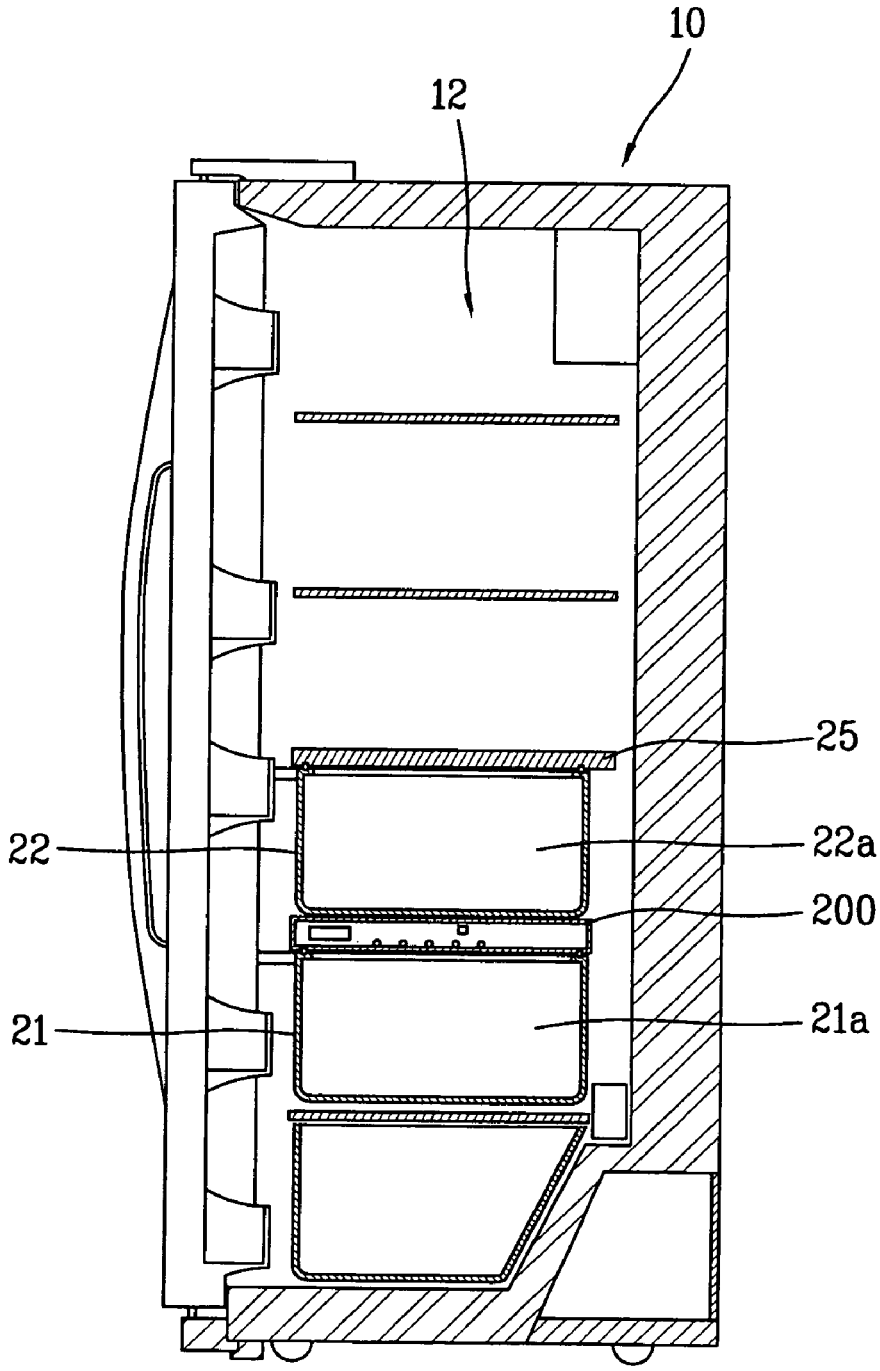
FIG. 14 is a sectional view illustrating a refrigerator, to which a cooling air supply apparatus according to a fifth preferred embodiment of the present invention is applied.

Referring to FIG. 14, a first receiving box 21 is mounted in the lower part of the refrigerating compartment 12 such that the first receiving box 21 can be inserted into the refrigerating compartment 12 and can be withdrawn from the refrigerating compartment. At the top part of the first receiving box 21 is fixedly disposed a cover 200 for covering the open top part of the first receiving box 21 in a hermetically sealed state to define a first hermetically-sealed storage chamber 21*a*. On the cover 200 is disposed a second receiving box 22. At the top part of the second receiving box 22 is fixedly disposed a blocking plate 25 for blocking the open top part of the second receiving box 22 in a hermetically sealed state to define a second-hermetically sealed storage chamber 22*a*.

Figure 15:
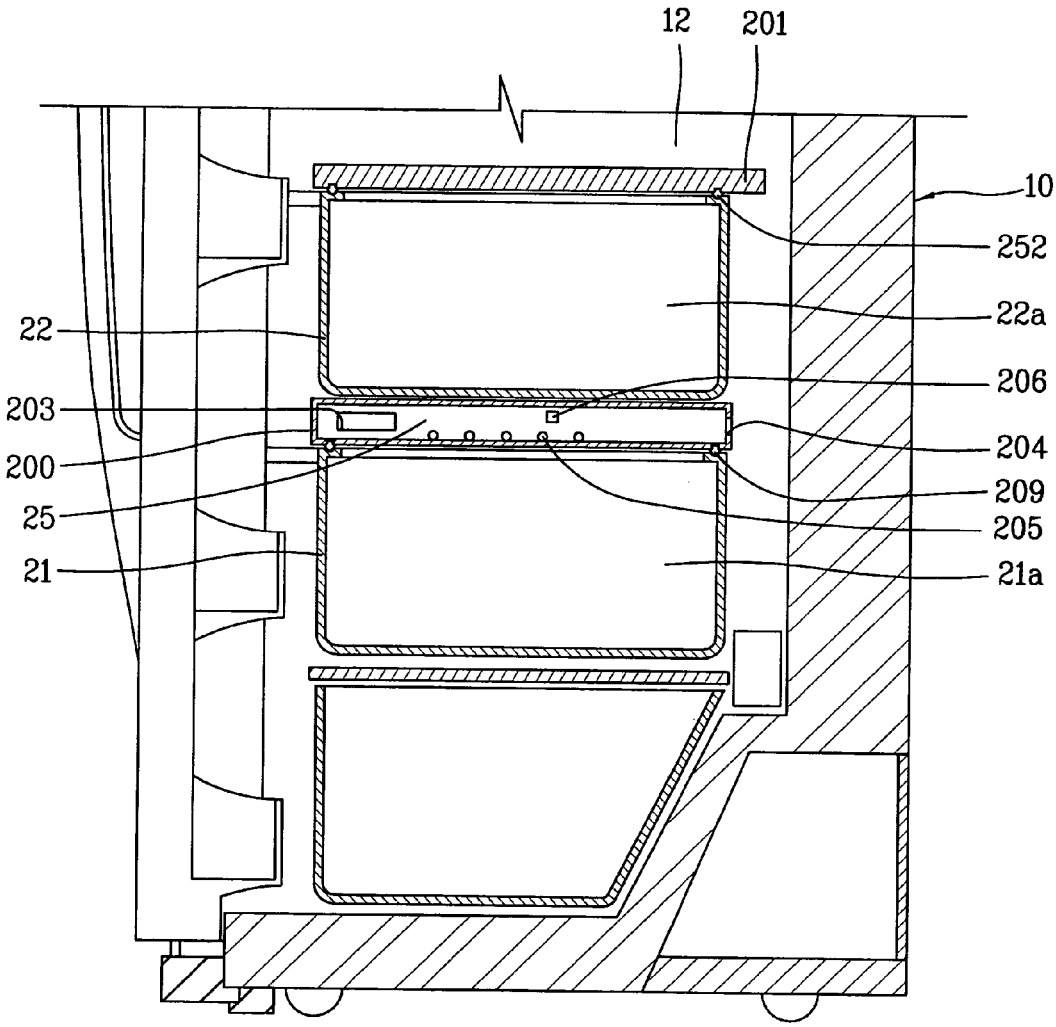
FIG. 15 is an enlarged sectional view of the cooling air supply apparatus shown in FIG. 14.
Figure 16:
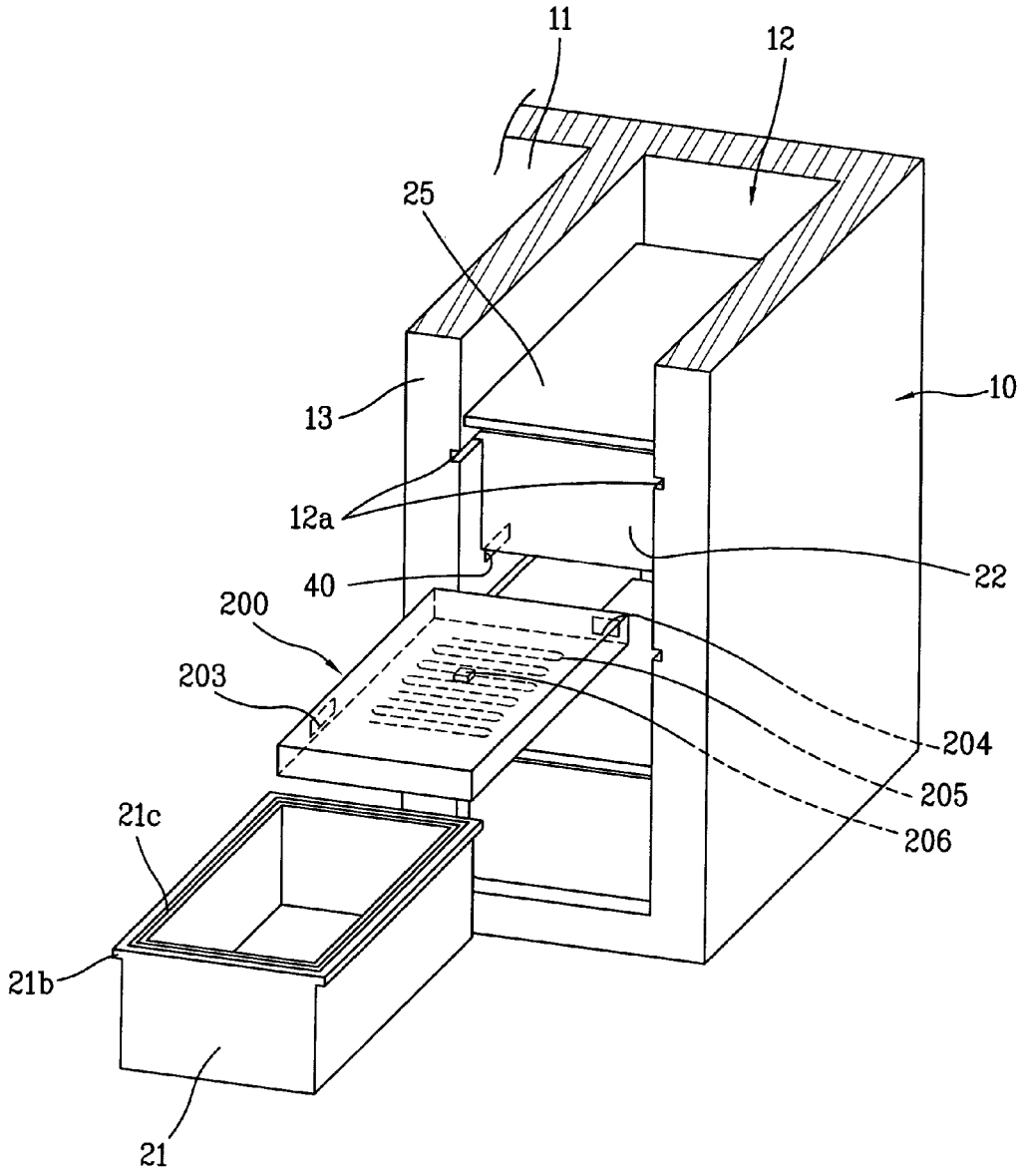
FIG. 16 is an exploded perspective view of the cooling air supply apparatus shown in FIG. 14.
Figure 17:
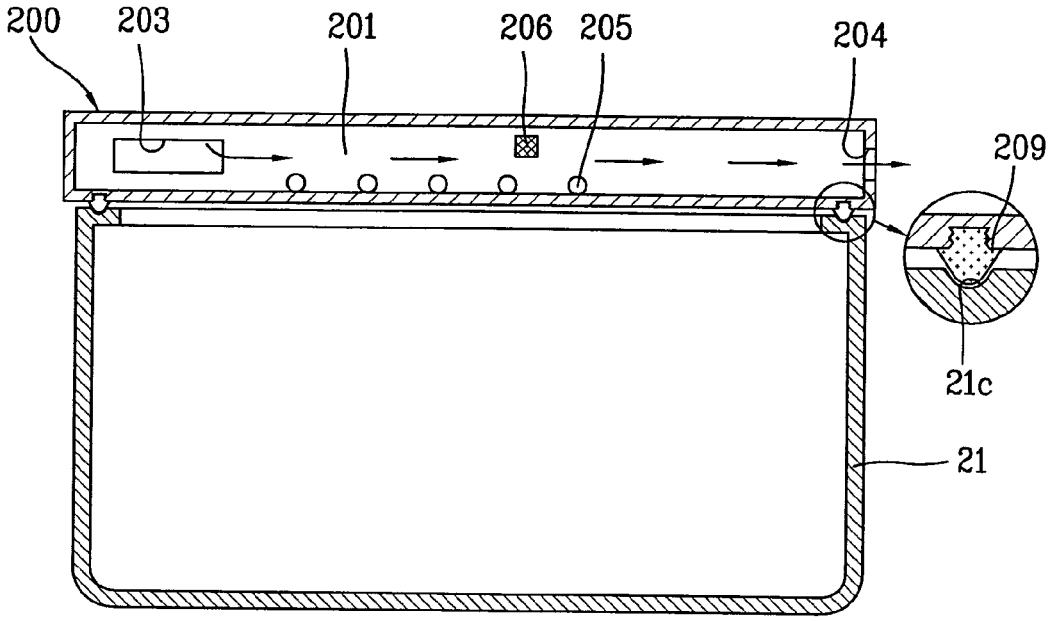
FIG. 17 is a sectional view illustrating the structure of the cooling air supply apparatus shown in FIG. 14.
Figure 18:
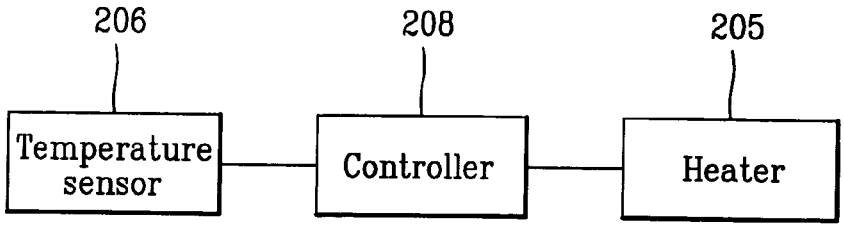
FIG. 18 is a block diagram illustrating the construction for operating a heater of the cooling air supply apparatus shown in FIG. 14.

As shown in FIG. 15, a gasket 252 is integrally coupled to the bottom of the blocking plate 25. The gasket 252 is brought into tight contact with the top part of the second receiving box 22 to isolate the second receiving box 22 from the refrigerating compartment 12 in a hermetically sealed fashion.

Also, as shown in FIGS. 15 to 18, a flange part 21*b* is formed at the upper end of the first receiving box 21 such that the flange part 21*b* extends in the lateral direction of the first receiving box 21, and a rail groove 12*a* is formed at the inner wall of the refrigerating compartment 12. The flange part 21*b* is engaged in the rail groove 12*a* such that the first receiving box 21 can be inserted into and withdrawn from the refrigerating compartment 12 in a sliding fashion. At the upper surface of the flange part 21*b* is formed a groove-shaped gasket contact part 21*c*, which is depressed in the thickness direction of the first receiving box 21 and extends along the circumference of the first receiving box 21. The gasket contact part 21*c* contacts a gasket 209, which will be described below, to effectively accomplish the sealing function.

The cover 200 is formed in the shape of a hollow rectangular box. In the cover 200 is defined a cooling air channel 201 having an introduction port 203 and a discharge port 204 such that the cooling air introduced into the cover 200 can flow along the cooling air channel 201. The introduction port 203 communicates with the communication port 40 formed at the barrier 13 such that the cooling air from the freezing compartment 11 can be introduced into the refrigerating compartment 12 through the introduction port 203. The discharge port 204 is formed through the rear end of the cover 200. To the bottom of the cover 200 is integrally coupled a gasket 209, which is brought into tight contact with the top part of the first receiving box 21 for isolating the first receiving box 21 from the refrigerating compartment 12 in a hermetically sealed fashion. The gasket 209 is made of an elastic member, such as rubber.

In the cover 200 is mounted a heater 205 for heating the interior of the cover 200 to prevent overcooling of the first hermetically-sealed storage chamber 21*a*. In the cover 200 is also mounted a temperature sensor 206, which is disposed adjacent to the heater 205 for detecting the temperature of the heater 205.

The temperature sensor 206 and the heater 205 are electrically connected to a control unit 208, which is constructed in the form of a microcomputer having a control program, such that the control unit 208 controls the interior of the first hermetically-sealed storage chamber 21*a* to be maintained at a predetermined temperature level.

When the user wishes to store food, such as vegetables or fruits, in the first and second hermetically-sealed storage chambers 21*a* and 22*a* constructed as described above, he/she pulls the first receiving box 21 and the second receiving box 22 frontward such that the first receiving box 21 and the second receiving box 22 can be withdrawn from the refrigerating compartment 12, and then puts food, such as vegetables or fruits, into the first receiving box 21 and the second receiving box 22. After that, when the user pushes the first receiving box 21 and the second receiving box 22, in which the food is received, rearward such that the first receiving box 21 and the second receiving box 22 can be inserted into the refrigerating compartment 12, the gaskets 209 and 252 are brought into tight contact with the top parts of the first receiving box 21 and the second receiving box 22, respectively. As a result, the interiors of the first receiving box 21 and the second receiving box 22 are hermetically sealed.

Meanwhile, cooling air introduced from the freezing compartment 11 through the communication port 40 formed at the barrier 13 flows along the cooling air channel 201 of the cover 200 to cool the interiors of the first hermetically-sealed storage chamber 21*a* and the second hermetically-sealed storage chamber 22*a*. The cooling air flowing along the cooling air channel 201 is discharged through the discharge port 204, and then flows along the space defined between the first and second receiving boxes 21 and 22 and the inner wall of the refrigerating compartment 12. As a result, the temperature around the first and second receiving boxes 21 and 22 is lowered.

The control unit 208 controls the heater 205 to be energized when the interior temperature of the first hermetically-sealed storage chamber 21*a* is lower than the predetermined temperature level based on the temperature detected by the temperature sensor 206. As a result, the interior of the first hermetically-sealed storage chamber 21*a* is heated, and therefore, overcooling of the first hermetically-sealed storage chamber 21*a* and the second hermetically-sealed storage chamber 22*a* is effectively prevented.

In this embodiment, one cover 200, which constitutes the cooling air supply apparatus, is disposed between the first receiving box 21 and the second receiving box 22.

Figure 19:
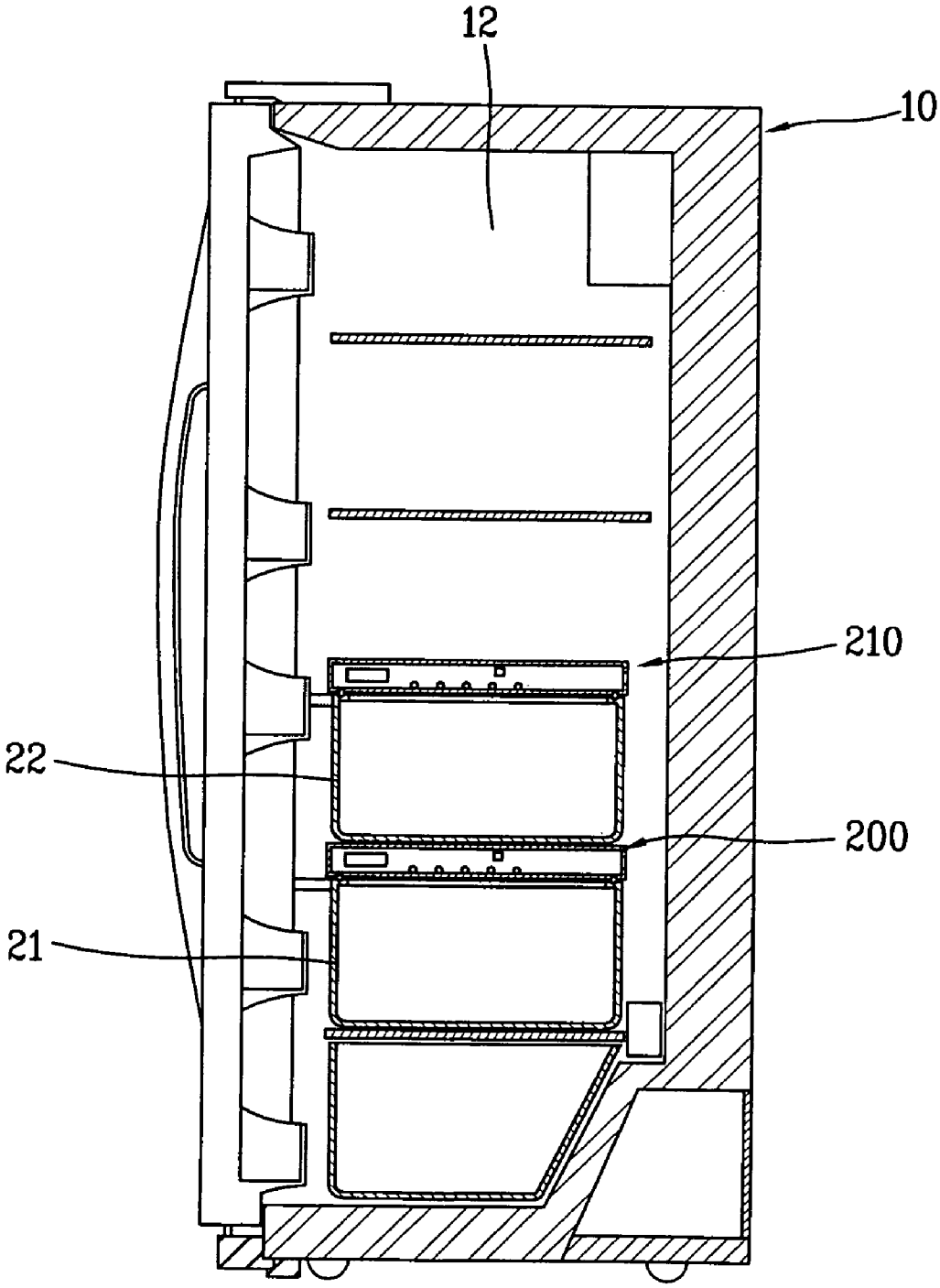
FIG. 19 is a sectional view illustrating a refrigerator, to which a cooling air supply apparatus according to a sixth preferred embodiment of the present invention is applied.

However, it is also possible to provide a first cover 200 and a second cover 210 at the top part of the first receiving box 21 and the top part of the second receiving box 20, respectively, as shown in FIG. 19. In this case, cooling air from the freezing compartment is supplied into the first receiving box 21 and the second receiving box 22 through the first and second covers 200 and 210, respectively, whereby the food received in the first receiving box 21 and the second receiving box 22 can be stored at a temperature lower than the interior temperature of the refrigerating compartment.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cooling air supply apparatus of a refrigerator compartment and a freezing compartment that stores food at low temperature, a barrier that partitions the refrigerating compartment and the freezing compartment from each other, and a receiving box mounted in the refrigerating compartment that receives food, wherein the cooling air supply apparatus comprises:

a communication port formed through the barrier that guides cooling air from the freezing compartment into the refrigerating compartment;

a hollow box-shaped cover mounted at a top part of the receiving box, wherein the cover includes:

an upper plate, comprising:

a top wall; and a sidewall that extends all the way along and downward from an outer peripheral edge of the top wall, including:

a front wall that extends downward from a front edge of the top wall;

a rear wall that extends downward from a rear edge of the top wall;

left and right lateral side walls that extend downward from left and right side edges, respectively, of the top wall; and a rim that extends inward from a lower peripheral edge of the sidewall so as to form a coupling surface;

an introduction port formed in the upper plate, at a peripheral portion thereof, so as to communicate with the communication port;

a lower plate coupled to a lower portion of the upper plate along corresponding edge portions thereof so as to define a hollow interior space therebetween, wherein the lower plate is coupled to the rim of the upper plate; and at least one cooling air supplying hole formed in the lower plate so as to communicate with an interior of the receiving box; and a duct that extends between the communication port and the introduction port such that the communication port and the introduction port communicate with each other, wherein the duct provides cooling air from the freezing compartment into the interior of the cover, and wherein substantially all of the cooling air provided through the duct is guided into the cover and into the interior of the receiving box through the at least one cooling air supplying hole.

2. The cooling air supply apparatus according to claim 1, wherein the at least one cooling air supplying hole comprises a plurality of cooling air supplying holes arranged at predetermined intervals along the lower plate, from a first end of the lower plate corresponding to the peripheral portion of the upper plate at which the introduction port is formed, to a second end of the lower plate opposite the first end thereof.

3. The cooling air supply apparatus according to claim 1, further comprising:

at least one guide rib that extends between the upper and lower space in the interior space defined therebetween, wherein the at least one guide rib guides cooling air introduced into the interior space through the introduction port to the at least one cooling air supplying hole.

4. The cooling air supply apparatus according to claim 3, wherein the at least one guide rib includes a plurality of guide ribs arranged opposite to each other.

5. The cooling air supply apparatus according to claim 3, wherein a height of the at least one guide rib is substantially equal to a distance between the upper and lower space within the interior space defined therebetween.

6. The cooling air supply apparatus according to claim 1, further comprising:

a cooling air amount controller that controls an opening level of the introduction port to control an amount of cooling air introduced into the receiving box.

7. The cooling air supply apparatus according to claim 6, wherein the cooling air amount controller includes:

a linear moving bar mounted at the cover such that the linear moving bar can be linearly moved, the linear moving bar having a blocking part that opens and closes the introduction port; and a driving member that linearly moves the linear moving bar.

8. The cooling air supply apparatus according to claim 7, wherein the driving member includes:

a handle mounted at the cover such that the handle can be linearly reciprocated by the manipulation of a user; and a pivoting bar mounted at the cover such that the pivoting bar can be rotated in a pivoting fashion about a rotary shaft, the pivoting bar having one end rotatably connected to the handle in a pivoting fashion and another end connected to an elongated hole formed at the linear moving bar, to convert the linear movement of the handle into the linear movement of the linear moving bar.

9. The cooling air supply apparatus according to claim 7, wherein the cooling air amount controller further includes:

a guide member that guides the linear movement of the linear moving bar.

10. The cooling air supply apparatus according to claim 9, wherein the guide member includes a pair of guide rails mounted at opposite sides of the introduction port, wherein the pair of guide rails are arranged in parallel with each other, such that opposite ends of the linear moving bar are inserted between the pair of guide rails and guided along the pair of guide rails.

11. The cooling air supply apparatus according to claim 9, wherein the guide member includes a plurality of guide ribs formed at the cover, such that the plurality of guide ribs protrude from the cover, to movably support opposite sides of the linear moving bar.

12. The cooling air supply apparatus according to claim 8, wherein the driving member further includes:

a handle guide member that guides the movement of the handle.

13. The cooling air supply apparatus according to claim 12, wherein the handle guide member includes:

a guide groove formed at the cover such that the guide groove extends along the movement direction of the handle, the handle being movably located inside the guide groove;

a guide slit formed through the cover such that the guide slit extends along the guide groove; and a guide pin formed at the handle such that the guide pin protrudes from the handle, the guide pin being rotatably connected to the pivoting bar in a pivoting fashion through the guide slit.

14. The cooling air supply apparatus according to claim 6, wherein the cooling air amount controller further includes:

a position holder that holds a movement position of the linear moving bar.

15. The cooling air supply apparatus according to claim 8, wherein the cooling air amount controller further includes:

a position holder that holds a movement position of the linear moving bar.

16. The cooling air supply apparatus according to claim 15, wherein the position holder includes:

a position holding plate, the position holding plate including:

a body fixedly mounted at the cover;

an elastic portion mounted at the body such that the elastic portion can be elastically moved, the elastic portion elastically contacting one end of the pivoting bar; and a plurality of seating parts concavely formed at the elastic portion at predetermined intervals, that hold a position of the pivoting bar.

17. The cooling air supply apparatus according to claim 16, wherein the position holder further includes:

a curved portion formed at the one end of the pivoting bar in a curved fashion such that the curved portion can be inserted into one of the plurality of seating parts.

18. The cooling air supply apparatus according to claim 1, wherein the duct includes an inlet port that communicates with the communication port and an outlet port that communicates with the introduction port.

* * * * *